US008816588B2

(12) United States Patent
Melanson

(10) Patent No.: US 8,816,588 B2
(45) **Date of Patent: *Aug. 26, 2014**

(54) HYBRID GAS DISCHARGE LAMP-LED LIGHTING SYSTEM

(75) Inventor: John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/334,411

(22) Filed: Dec. 22, 2011

(65) Prior Publication Data

US 2012/0091904 A1 Apr. 19, 2012

Related U.S. Application Data

(63) Continuation of application No. 11/767,523, filed on Jun. 24, 2007, now Pat. No. 8,102,127.

(51) Int. Cl.
*H05B 35/00* (2006.01)

(52) U.S. Cl.
USPC ..... 315/178; 315/291; 315/360

(58) Field of Classification Search
USPC ..... 315/178, 183, 291, 312, 324, 360
See application file for complete search history.

(56) References Cited

U.S. PATENT DOCUMENTS

| | | | |
|---|---|---|---|
| 4,409,476 A | 10/1983 | Lofgren et al. | |
| 6,016,038 A | 1/2000 | Mueller et al. | |
| 6,150,774 A | 11/2000 | Mueller et al. | |
| 6,211,620 B1 * | 4/2001 | Gyoten et al. | 315/106 |
| 6,211,626 B1 | 4/2001 | Lys et al. | |
| 6,369,525 B1 | 4/2002 | Chang et al. | |

(Continued)

FOREIGN PATENT DOCUMENTS

| | | |
|---|---|---|
| EP | 1528785 | 4/2005 |
| EP | 1842399 | 10/2007 |

(Continued)

OTHER PUBLICATIONS

Dyble, et al, Impact of Dimming White LEDS: Chromaticity Shifts in High-Power White LED Systems Due to Different Dimming Methods, International Society of OpticalEngineers, 2005, Fifth International Conference on Solid State Lighting, Proceedings of SPIE 5941: 291-299, Troy, NY, USA.

(Continued)

*Primary Examiner* — Thuy Vinh Tran
(74) *Attorney, Agent, or Firm* — Terrile, Cannatti, Chambers & Holland, LLP; Kent B. Chambers

(57) ABSTRACT

A lighting system and method combine at least one LED and at least one gas discharge lamp within a common housing. The lighting system includes a control system to dependently operate each LED and each gas discharge lamp during overlapping, non-identical periods of time. In at least one embodiment, the control system can provide light output by activating LEDs during gas discharge preheating operations and thus extend the useful life of each gas discharge lamp. When dimming the lighting system, the control system can reduce current to the gas discharge lamps and one or more gas discharge lamps can be phased out as dimming levels decrease. As dimming levels decrease, one or more of the LEDs can be activated or groups of LEDs can be phased in to replace the light output of the dimmed gas discharge lamps. Thus, the lighting system can reduce power consumption at low dimming levels.

33 Claims, 5 Drawing Sheets

(56) References Cited

U.S. PATENT DOCUMENTS

| | | | | |
|---|---|---|---|---|
| 6,441,558 | B1 | 8/2002 | Muthu et al. | |
| 6,495,964 | B1 | 12/2002 | Muthu et al. | |
| 6,583,550 | B2 | 6/2003 | Iwasa et al. | |
| 6,636,003 | B2 | 10/2003 | Rahm et al. | |
| 6,688,753 | B2 | 2/2004 | Calon et al. | |
| 6,753,661 | B2 | 6/2004 | Muthu et al. | |
| 6,756,772 | B2 | 6/2004 | McGinnis | |
| 6,788,011 | B2 | 9/2004 | Mueller et al. | |
| 6,888,322 | B2 | 5/2005 | Dowling et al. | |
| 6,958,920 | B2 | 10/2005 | Mednik et al. | |
| 6,967,448 | B2 | 11/2005 | Morgan et al. | |
| 6,975,079 | B2 | 12/2005 | Lys et al. | |
| 7,064,498 | B2 | 6/2006 | Dowling et al. | |
| 7,079,791 | B2 * | 7/2006 | Chang et al. | 399/220 |
| 7,088,059 | B2 | 8/2006 | McKinney et al. | |
| 7,116,294 | B2 | 10/2006 | Stopa | |
| 7,135,824 | B2 | 11/2006 | Lys et al. | |
| 7,213,940 | B1 | 5/2007 | Van De Ven et al. | |
| 7,246,919 | B2 | 7/2007 | Porchia et al. | |
| 7,255,457 | B2 | 8/2007 | Ducharme et al. | |
| 7,288,902 | B1 | 10/2007 | Melanson | |
| 7,375,476 | B2 | 5/2008 | Walter et al. | |
| 7,498,753 | B2 * | 3/2009 | McAvoy et al. | 315/291 |
| 7,511,437 | B2 | 3/2009 | Lys et al. | |
| 7,579,790 | B2 * | 8/2009 | Tipton | 315/323 |
| 7,804,478 | B2 * | 9/2010 | Schou | 345/102 |
| 7,804,480 | B2 | 9/2010 | Jeon et al. | |
| 2002/0145041 | A1 | 10/2002 | Muthu et al. | |
| 2004/0085030 | A1 | 5/2004 | LaFlamme et al. | |
| 2004/0169477 | A1 | 9/2004 | Yanai | |
| 2004/0212321 | A1 | 10/2004 | Lys et al. | |
| 2005/0218838 | A1 | 10/2005 | Lys et al. | |
| 2005/0231459 | A1 | 10/2005 | Furukawa | |
| 2005/0243022 | A1 | 11/2005 | Negru | |
| 2005/0253533 | A1 | 11/2005 | Lys et al. | |
| 2006/0023002 | A1 | 2/2006 | Haea et al. | |
| 2006/0125420 | A1 | 6/2006 | Boone et al. | |
| 2006/0226795 | A1 | 10/2006 | Walter et al. | |
| 2006/0232219 | A1 | 10/2006 | Xu | |
| 2006/0238136 | A1 | 10/2006 | Johnson, III et al. | |
| 2007/0029946 | A1 | 2/2007 | Yu et al. | |
| 2007/0126656 | A1 | 6/2007 | Huang et al. | |
| 2007/0211013 | A1 | 9/2007 | Uehara et al. | |
| 2007/0262724 | A1 | 11/2007 | Mednik et al. | |
| 2008/0012502 | A1 | 1/2008 | Lys | |
| 2008/0018261 | A1 | 1/2008 | Kastner | |
| 2008/0054815 | A1 | 3/2008 | Kotikalapoodi et al. | |
| 2008/0116818 | A1 | 5/2008 | Shteynberg et al. | |
| 2008/0224635 | A1 | 9/2008 | Hayes | |
| 2009/0218960 | A1 | 9/2009 | Lyons et al. | |

FOREIGN PATENT DOCUMENTS

| | | | |
|---|---|---|---|
| WO | 02/091805 | A2 | 11/2002 |
| WO | 02091805 | A2 | 11/2002 |
| WO | 2006067521 | | 6/2006 |
| WO | 2007/026170 | A2 | 3/2007 |
| WO | 2007026170 | A2 | 3/2007 |
| WO | 2006/067521 | A1 | 6/2008 |
| WO | 2008/072160 | A1 | 6/2008 |
| WO | 2011/061505 | A1 | 5/2011 |
| WO | 2011061505 | | 5/2011 |

OTHER PUBLICATIONS

Color Temperature, www.sizes.comlunits/color_temperature.htm, printed Mar. 27, 2007.

Linear Technology, Triple Output LED Driver, Datasheet LT3496, Linear Technology Corporation, LT 0510 Rev F, 2007, Milpitas, CA, USA.

Dilouie, Craig, Introducing the LED Driver, Electrical Construction & Maintenance (EC&M), Sep. 1, 2004, ,pp. 28-32, Zing Communications, Inc., Calgary, Alberda, Canada.

Wikipedia, Light-Emitting Diode, http://en.wikipedia.org/wiki/Light-emitting_diode, printed Mar. 27, 2007.

Linear Technology, News Release, Triple Output LED Driver Drives Up to 24×500mA Leds & Offers 3,000:1 True Color PWM Dimming, Mar. 24, 2007, Milpitas, CA, USA.

Ohno, Yoshi, Spectral Design Considerations for White LED Color Rendering, Optical Engineering, vol. 44, Issue 11, Special Section on Solid State Lighting, Nov. 30, 2005, Gaithersburg, MD, USA.

Non-Final OA mailed on Aug. 11, 2010 in parent U.S. Appl. No. 11/767,523, 12 pgs.

Response to Non-Final OA filed in parent U.S. Appl. No. 11/767,523 on Jan. 11, 2011, 17 pgs.

Final OA mailed on Apr. 5, 2011 in parent U.S. Appl. No. 11/767,523, 8 pgs.

Response to Final OA filed in parent U.S. Appl. No. 11/767,523 on Sep. 6, 2011, 11 pgs.

Notice of Allowance mailed on Sep. 14, 2011 in parent U.S. Appl. No. 11/767,523, 7 pgs.

Chromacity Shifts in High-Power White LED Systems Due toDifferent Dimming Methods, Solid-State Lighting, 2005, pp. 1-2, http://www.lrc.rpi.edu/programs/solidstate/completedprojects.asp?ID=76, printed May 3, 2007.

Color Temperature, Sizes, Inc., www.sizes.com/units/color_temperature.htm, Oct. 10, 2002, pp. 1-3, printed Mar. 27, 2007.

Linear Technology, News Release, Data Sheet LT3496,Triple Output LED Driver Drives Up to 24×500mA LEDs & Offers 3,000:1 True Color PWM Dimming, 2007, pp. 1-2, Milpitas, CA, USA.

C. Dilouie, Introducing the LED Driver, Electrical Construction & Maintenance (EC&M), Sep. 1, 2004, pp. 28-30, Zing Communications, Chicago, IL, USA.

Wikipedia, Light Emitting Diode, http://er.wikipedia.org/wiki/Light-emiting_diode, Mar. 2007, pp. 1-16, printed Mar. 27, 2007.

Y. Ohno, Spectral Design Considerations for White LED Color Rendering, Final Manuscript, Optical Engineering, Nov. 30, 005, pp. 1-20, vol. 44, 111302, Special Section on Solid State Lighting, National Institute of Standards and Technology, Gaithersburg, MD, USA.

* cited by examiner

HYBRID GAS DISCHARGE LAMP-LED LIGHTING SYSTEM

CROSS-REFERENCE TO RELATED APPLICATIONS

This application is a continuation of application Ser. No. 11/767,523, filed Jun. 24, 2007, which is now U.S. Pat. No. 8,102,127 B2, and which is incorporated herein by reference in its entirety.

BACKGROUND OF THE INVENTION

1. Field of the Invention

The present invention relates in general to the field of lighting, and more specifically to a hybrid gas discharge lamp-led lighting system and method.

2. Description of the Related Art

Commercially practical incandescent light bulbs have been available for over 100 years. However, other light sources show promise as commercially viable alternatives to the incandescent light bulb. Gas discharge light sources (such as fluorescent, mercury vapor, low pressure sodium) and high pressure sodium lamps and light emitting diode (LED), represent two categories of light source alternatives to incandescent lamps. LEDs are becoming particularly attractive as main stream light sources in part because of energy savings through high efficiency light output and environmental incentives such as the reduction of mercury.

Incandescent lamps generate light by passing current through a filament located within a vacuum chamber. The current causes the filament to heat and produce light. The filament produces more heat as more current passes through the filament. For a clear vacuum chamber, the temperature of the filament determines the color of the light. A lower temperature results in yellowish tinted light and a high temperature results in a bluer, whiter light.

Gas discharge lamps include a housing that encloses gas. For a typical hot-cathode bulb, the housing is terminated by two filaments. The filaments are pre-heated during a pre-heat period, and then a high voltage is applied across the tube. An arc is created in the ionized gas to produce light. Once the arc is created, the resistance of the lamp decreases. A ballast regulates the current supplied to the lamp. Fluorescent lamps are common form of a gas discharge lamp. Fluorescent lamps contain mercury vapor and produce ultraviolet light. The housing interior of the fluorescent lamps include a phosphor coating to convert the ultraviolet light into visible light.

LEDs are semiconductor devices and are driven by direct current. The lumen output intensity (i.e. brightness) of the LED varies approximately in direct proportion to the current flowing through the LED. Thus, increasing current supplied to an LED increases the intensity of the LED, and decreasing current supplied to the LED dims the LED. Current can be modified by either directly reducing the direct current level to the LEDs or by reducing the average current through pulse width modulation.

Instantly starting gas discharge lamps, such as fluorescent lamps, without sufficiently pre-heating filaments of the lamps can reduce lamp life. To increase lamp life, ballasts preheat gas discharge lamp filaments for a period of time. The amount of preheat time varies and is, for example, between 0.5 seconds and 2.0 seconds for fluorescent lamps. Generally, longer preheat times result in longer lamp life. However, when a light fixture is turned 'on', users generally desire near instantaneous illumination.

FIG. 1 depicts a light-power graph 100 comparing relative light output versus active power for a fluorescent lamp dimming ballast. A fluorescent lamp can be dimmed by reducing the amount of current supplied to the lamp. Fluorescent lamps are not 100% efficient due to, for example, the heating of lamp filaments, which converts some drive current into heat rather than light. At low dimming levels, the inefficiencies of fluorescent lamps are particularly notable. For example, if 70 watts are used to generate 100% light output (point 102) and an average of 17 watts of power are used to generate 5% relative light output (point 104), when dimming from 100% light output to 5% light output, the ratio of Watts/Light Output increases from 0.7 to approx. 3.4.

SUMMARY OF THE INVENTION

In one embodiment of the present invention, a hybrid gas discharge lamp-light emitting diode (LED) lighting system includes a housing, an LED retained by the housing, and a gas discharge lamp retained by the housing. The system further includes a control system coupled to the LED and the gas discharge lamp to dependently operate the LED and gas discharge lamp during overlapping, non-identical periods of time.

In another embodiment of the present invention, a lighting system control system to control a hybrid gas discharge lamp-light emitting diode (LED) lighting system includes a first output to provide an LED control signal and a second output to provide a gas discharge lamp control signal. The control system also includes circuitry to dependently operate at least one LED and at least one gas discharge lamp during overlapping, non-identical periods of time.

In a further embodiment of the present invention, a method of controlling a hybrid gas discharge lamp-light emitting diode (LED) includes supplying a control signal to a control system configured to control operation of an LED and a gas discharge lamp retained by a housing. The method further includes operating the LED and gas discharge lamp dependently during overlapping, non-identical periods of time.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

A lighting system and method combine at least one light emitting diode (LED) and at least one gas discharge lamp within a common housing. The lighting system includes a control system to dependently operate each LED and each gas discharge lamp during overlapping, non-identical periods of time. Thus, in at least one embodiment, the control system can instantaneously provide light output while extending the useful life of each gas discharge lamp and reducing power consumption at low dimming levels. In at least one embodiment, when the lighting system is turned 'on', the control system can activate one or more of the LEDs while preheating the gas discharge lamp. Thus, each activated LED provides light output prior to generation of light output by the gas discharge lamp. Upon completion of lamp preheating, one or more of the LEDs can remain ON or be deactivated. When the lighting system is dimmed, current to the gas discharge lamps can be decreased and one or more gas discharge lamps can be phased out as dimming levels decrease. As dimming levels decrease, the control system can activate one or more of the LEDs or groups of LEDs can be phased in to replace the light output of the dimmed gas discharge lamps. Thus, the lighting system can extend the useful life of each gas discharge lamp and reduce power consumption at low dimming levels.

The lighting system can use a combination of LEDs and gas discharge lamps in a light fixture to achieve lower costs relative to light fixtures that use only LEDs, increase the life span of the light fixture, and provide improved light output and energy savings during activation of the light fixture and at various dimming levels. The cost of LEDs/lumen output is currently greater than the cost of many gas discharge lights/lumen. For example, for the same cost, a consumer can purchase a fluorescent lamp that produces more light than an LED or set of LEDs that produces the same amount of light. However, LEDs have some advantages over gas discharge lights. For example, LEDs are more efficient than gas discharge lights when dimmed, i.e. LEDs provide more light output for the same amount of power, and the operational life span of LEDs typically exceeds the operational life span of gas discharge lamps, particularly fluorescent lamps.

The lighting system also includes a control system that dependently operates LED(s) and gas discharge lamp(s) in a light fixture to leverage the advantages of the LED(s) and gas discharge lamp(s).

Figure 1:
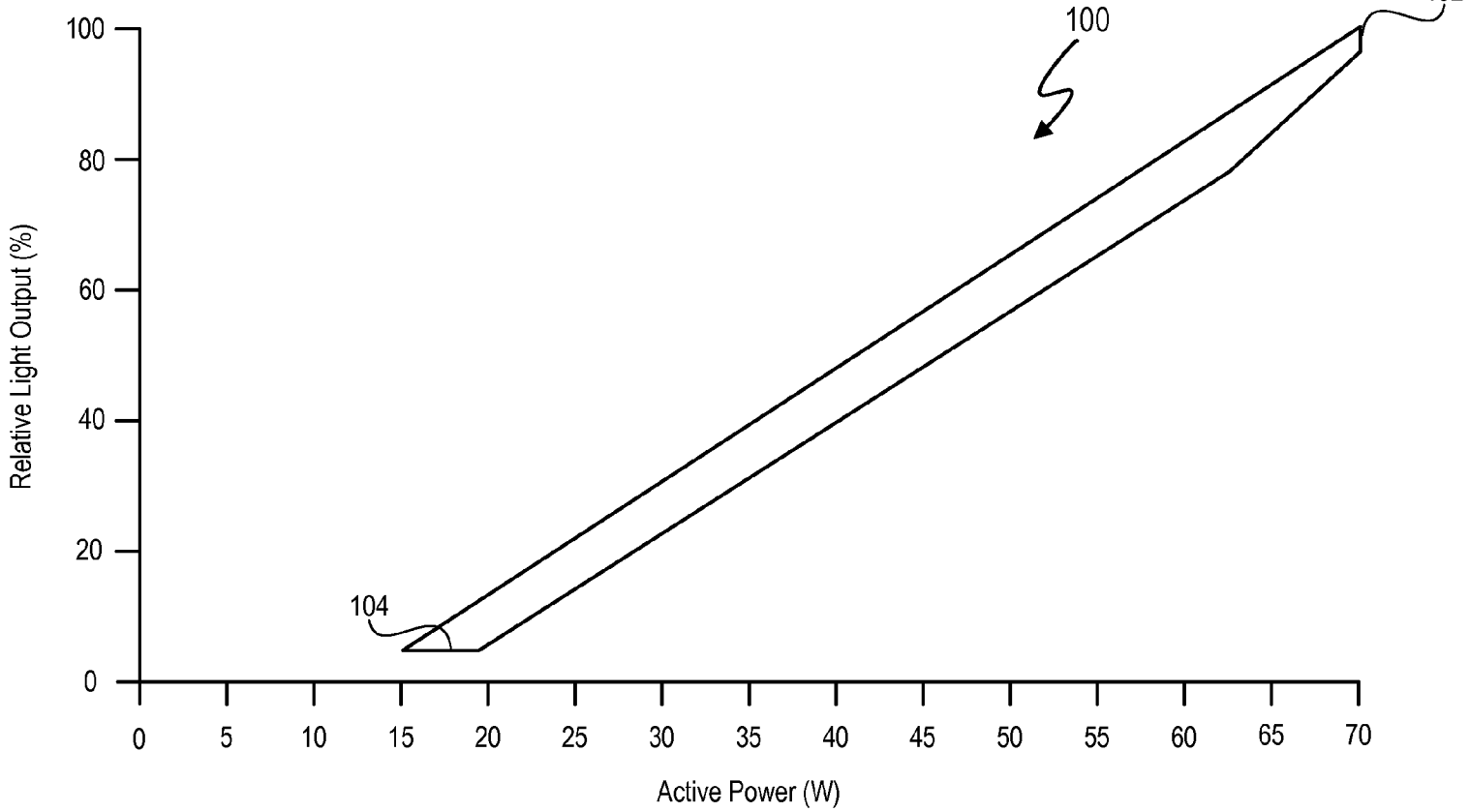
FIGURE 1 (prior art)
FIG. 1 (labeled prior art) depicts a light-power graph comparing relative light output versus active power for a fluorescent lamp.
Figure 2:
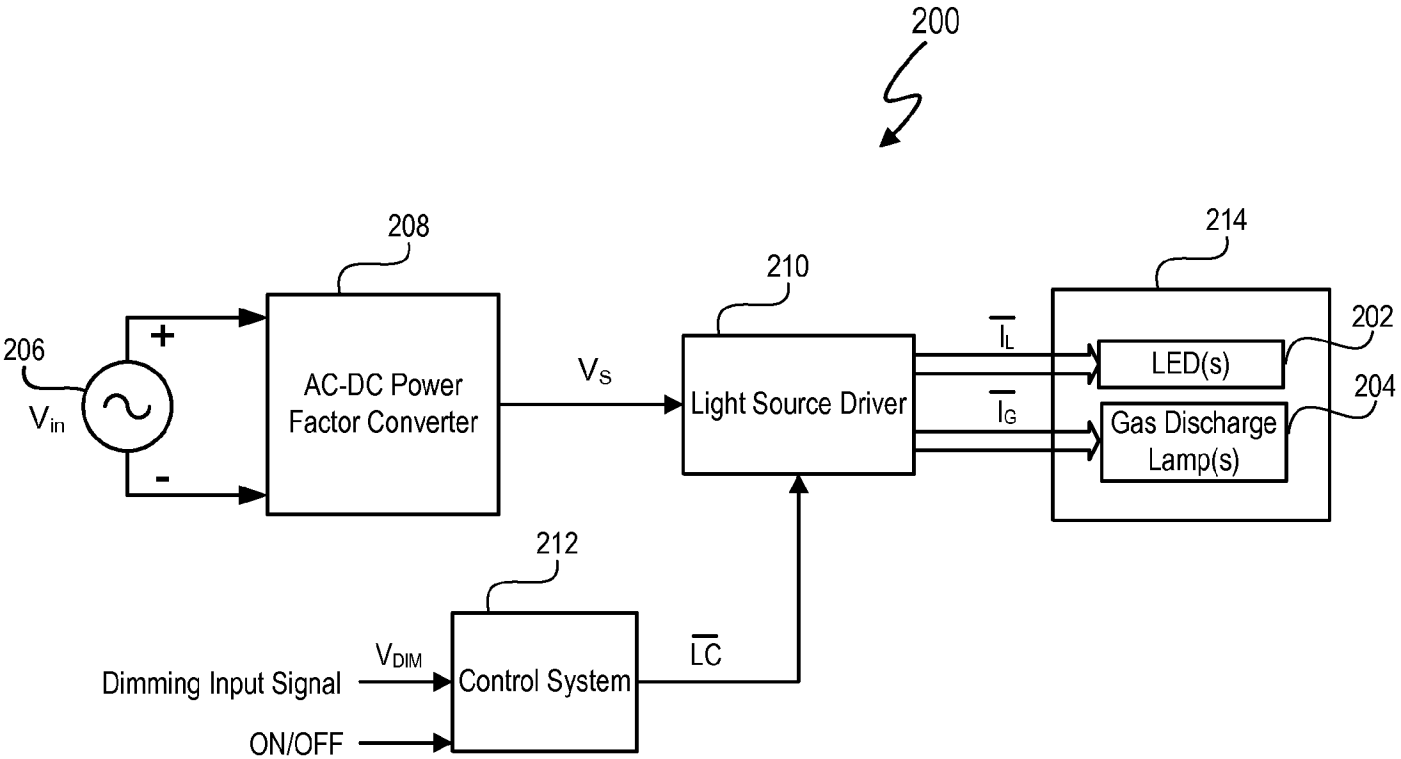
FIG. 2 depicts a block diagram of an exemplary lighting system that controls the light output of one or more light emitting diodes (LEDs) and one or more gas discharge lamps.

FIG. 2 depicts an exemplary lighting system 200 that controls the light output of each LED 202 and gas discharge lamp 204 of light fixture 214. An alternating current (AC) source 206 provides an input voltage $V_{in}$ to an AC-direct current (DC) power factor converter 208. In at least one embodiment, the input voltage $V_{in}$ is a 110-120 VAC, 60 Hz line voltage. In another embodiment, the input voltage $V_{in}$ is a duty cycle modified dimmer circuit output voltage. Any input voltage and frequency can be used. AC-DC power converter 208 can be any AC-DC power converter, such as the exemplary AC-DC power converter described in U.S. Provisional Patent Application Ser. No. 60/909,458, entitled "Ballast for Light Emitting Diode Light Sources", filed on Apr. 1, 2007, inventor John L. Melanson. The AC-DC power converter 208 converts the line voltage $V_{in}$ into a steady state voltage $V_S$ and supplies the steady voltage $V_S$ to light source driver 210. The light source driver 210 provides a current drive signal $\bar{I}_L$ to LED(s) 202 and a current drive signal $\bar{I}_G$ to gas discharge lamp(s) 204. Increasing current to the LED(s) 202 and gas discharge lamp(s) 204 increases the intensity of the LED(s) 202 and gas discharge lamp(s) 204. Conversely, decreasing current to the LED(s) 202 and gas discharge lamp(s) 204 decreases the intensity of the LED(s) 202 and gas discharge lamp(s) 204.

Current drive signal $\bar{I}_L$ is a vector that can include a single current drive signal for all LED(s) 202 or can be a set N+1 of current drive signals, $\{I_{L0}, I_{L1}, \ldots I_{LN}\}$, that drive individual LEDs and or subsets of LEDs. N+1 is an integer greater than or equal to 1 and, in at least one embodiment, equals the number LED(s) 202. Current drive signal $\bar{I}_G$ is also vector that can include a single current drive signal for all gas discharge lamp(s) 202 or can be a set M+1 of current drive signals, $\{I_{L0}, I_{L1}, \ldots I_{LM}\}$, that drive individual LEDs and or subsets of LEDs. M+1 is also an integer greater than or equal to 1, and, in at least one embodiment, represents the number gas discharge lamp(s) 202. The Melanson patents also describe exemplary systems for generating current drive signals.

The control system 212 dependently operates each LED 202 and each gas discharge lamp 204 during overlapping, non-identical periods of time. Non-identical periods of time means time periods that have different start times and/or different end times but do not have the same start times and same end times. Overlapping periods of time means that the periods of time co-exist for a duration of time. Control system 212 can be implemented using, for example, integrated circuit based logic, discrete logic components, software, and/or firmware. Control system 212 receives a dimming input signal $V_{DIM}$. Dimming input signal $V_{DIM}$ can be any digital or analog signal generated by a dimmer system (not shown). The dimming input signal $V_{DIM}$ represents a selected dimming level ranging from 100% dimming to 0% dimming. A 100% dimming level represents no light output, and a 0% dimming level representing full light output (i.e. no dimming) In at least one embodiment, the dimming input signal $V_{DIM}$ is the input voltage $V_{in}$. U.S. Provisional Patent Application Ser. No. 60/909,458, entitled "Ballast for Light Emitting Diode Light Sources", filed on Apr. 1, 2007, inventor John L. Melanson, U.S. patent application Ser. No. 11/695,023, entitled "Color Variations in a Dimmable Lighting Device with Stable Color Temperature Light Sources", filed on Apr. 1, 2007, inventor John L. Melanson, U.S. Provisional Patent Application Ser. No. 60/909,457, entitled "Multi-Function Duty Cycle Modifier", filed on Apr. 1, 2007, inventors John L. Melanson and John J. Paulos, and U.S. patent application Ser. No. 11/695,024, entitled "Lighting System with Lighting Dimmer Output Mapping", filed on Apr. 1, 2007, inventors John L. Melanson and John J. Paulos, all commonly assigned to Cirrus Logic, Inc. and collectively referred to as the "Melanson patents", describe exemplary systems for detecting the dimming level indicated by the dimming signal $V_{DIM}$. The Melanson patents are hereby incorporated by reference in their entireties.

Control system 212 can also receive a separate ON/OFF signal indicating that the light fixture 214 should be turned ON or OFF. In another embodiment, a 0% dimming input signal $V_{DIM}$ indicates ON, and a 100% dimming input signal $V_{DIM}$ indicates OFF.

The control system 212 provides a light source control signal $\overline{LC}$ to light source driver 210. The light source driver 210 responds to the light source control signal $\overline{LC}$ by supplying current drive signals $\bar{I}_L$ and $\bar{I}_G$ that cause the respective LED(s) 202 and gas discharge lamp(s) 204 to operate in accordance with the light source control signal $\overline{LC}$. The light source control signal $\overline{LC}$ can be, for example, a vector with light control signal elements $LC_0, LC_1, \ldots, LC_{M+N+2}$ for controlling (i) each of the LED(s) 202 and gas discharge lamp(s), (ii) a vector with control signals for groups of the LED(s) 202 and/or gas discharge lamp(s) 204, or (iii) a single coded signal that indicates a light output percentage for the LED(s) 202 and gas discharge lamp(s) 204. The light source control signal $\overline{LC}$ can be provided via a single conductive path (such as a wire or etch run) or multiple conductive paths for each individual control signal.

In at least one embodiment, the control system 212 dependently operates each LED and each gas discharge lamp during overlapping, non-identical periods of time. In at least one embodiment, the light fixture 214 is OFF (i.e. all light sources in light fixture 214 are OFF), and the control system 212 receives a signal to turn the light fixture 214 ON. To provide an instantaneous light output response, the control system 212 supplies a control signal $\overline{LC}$ to light source driver 210 requesting activation of LED(s) 202 (i.e. turned ON) and requesting preheating of the filaments of gas discharge lamp (s) 204. The light source driver 210 responds by supplying a current drive signal $I_L$ to the LED(s) 202 to activate the LED (s) 202 and supplying a current drive signal $I_G$ to the gas discharge lamp(s) 204 to preheat the filaments of the gas discharge lamp(s) 204. The particular values of current drive signals $I_L$ and $I_G$ depend upon the current-to-light output characteristics of the light fixture 214 and particular dimming levels requested by control system 212.

The LED(s) 202 can be overdriven to provide greater initial light output, especially prior to the gas discharge lamp(s) 205 providing full intensity light. "Overdriven" refers to providing a current drive signal $I_L$ that exceeds the manufacturer's maximum recommended current drive signal for the LED(s) 202. The LED(s) 202 can be overdriven for a short amount of time, e.g. 2-10 seconds, without significantly degrading the operational life of the LED(s) 202. By overdriving the LED(s) 202, fewer LED(s) 202 can be included in light fixture 214 while providing the same light output as a larger number of LED(s) operated within a manufacturer's maximum operating recommendations. The number of LED(s) 202 is a matter of design choice and depends upon the maximum amount of desired illumination from the LED(s). Because the human eye adapts to low light levels, the perceived light output of the LED(s) will be greater than the actual light output if the human eye has adapted to a low light level. It has been determined that having 10%-20% of the output light power immediately available is effective in providing the appearance of "instant on."

When the lighting system is dimmed, current to the gas discharge lamps can be decreased and one or more gas discharge lamps can be phased out as dimming levels decrease. In at least one embodiment, as dimming levels decrease and current is decreased to the gas discharge lamps, the control system 212, with no more than an insubstantial delay, e.g. (no more than 3 seconds), can activate one or more of the LEDs, or the control system 212 can phase in groups of LEDs to replace the light output of the dimmed gas discharge lamps.

Figure 3:
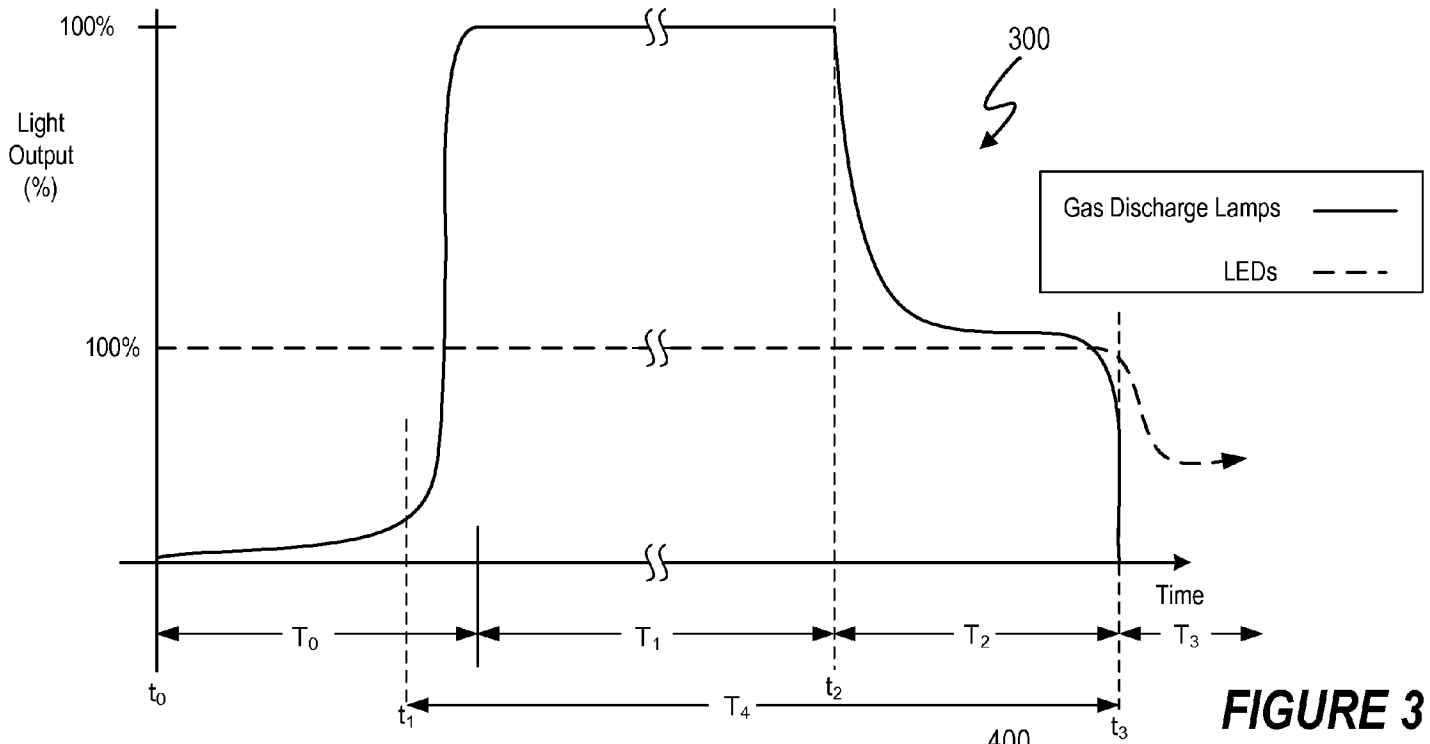
FIG. 3 depicts an LED-gas discharge lamp coordination graph.

FIG. 3 depicts an exemplary LED-gas discharge lamp coordination graph 300 for LED(s) 202 and gas discharge lamp(s) during overlapping, non-identical periods of time. In the embodiment of FIG. 3, control system 212 receives an activation ON/OFF signal at the start of time period $t_0$, with dimming input signal $V_{DIM}$ indicating 100% intensity during time periods $T_0$ and $T_1$, 50% intensity during time period $T_2$, and 10% intensity during time period $T_3$.

At time $t_0$, the beginning of time period $T_0$, control system 212 provides a control signal $\overline{LC}$ to light source driver 210 requesting light source driver 210 to activate the LED(s) 202. Light source driver 210 responds by activating LED(s) 202 with a current drive signal $I_L$ that produces at least 100% output of the LED(s) 202. During time period $T_0$, control system 212 provides a control signal $\overline{LC}$ to light source driver 210 requesting light source driver 210 to warm the filaments of gas discharge lamp(s) 204. Light source driver 210 responds by providing a current drive signal $I_G$ to warm the filaments of gas discharge lamp(s) 204.

At time $t_1$, the filaments of gas discharge lamp(s) 204 have been sufficiently warmed to extend the life of the lamp(s) 204, and control system 212 provides a light control signal $\overline{LC}$ to light source driver 210 requesting light source driver 210 continue activation of LED(s) 202 and provide a current signal $I_L$ to gas discharge lamp(s) 204 to cause gas discharge lamp(s) 204 to provide 100% light output. During time period $T_1$, the gas discharge lamp(s) 204 are fully ON and the LED (s) 202 are ON.

At time $t_2$, the beginning of time period $T_2$, the dimming input signal $V_{DIM}$ indicates 50% light intensity. The control system 212 can dim light fixture 214 in a number of ways by, for example, dimming individual LED(s) 202 and gas discharge lamp(s) 204, dimming subsets of the LED(s) 202 and gas discharge lamp(s) 204, or dimming gas discharge lamp(s) 204 and increasing current supplied to the LED(s) 202. In at least one embodiment, the subsets are proper subsets, i.e. a proper subset of a set of elements contains fewer elements than the set. The selected dimming levels can range from 100% to 0% by, for example, turning different combinations of the LED(s) 202 and gas discharge lamp(s) 204 ON and OFF. In the embodiment of graph 300, control system 212 provides light control signal $\overline{LC}$ to light source driver 210 requesting deactivation of two of three gas discharge lamps 204 and dimming of all LED(s) 202 to achieve a 50% dimming level for light fixture 214.

At time $t_3$, the beginning of time period $T_3$, the dimming input signal $V_{DIM}$ indicates 10% dimming. In at least one embodiment, to maximize energy efficiency, at time $t_3$ control system 212 provides light control signal $\overline{LC}$ to light source driver 210 requesting deactivation of all gas discharge lamps 204 and dimming of all LED(s) 202 to achieve a 10% dimming level for light fixture 214. Table 1 contains exemplary dependent combinations of LED(s) 202 and gas discharge lamp(s) 204 for exemplary dimming levels. Thus, the LED(s) 202 are ON during time periods $T_1$-$T_3$, and the gas discharge lamps 204 are ON during overlapping, non-identical time period $T_4$.

TABLE 1

| Dimming Level (DL) | LED(s) 202 | Gas Discharge Lamp(s) 204 |
|---|---|---|
| 50% ≤ DL ≤ 100% | All LED(s) ON with appropriate dimming | All Lamp(s) ON with appropriate dimming |
| 10% ≤ DL < 50% | All LED(s) ON with appropriate dimming | One Lamp ON with appropriate dimming, all others OFF. |
| 0% < DL ≤ 10% | All LED(s) ON with appropriate dimming | All Lamps OFF |

The exact numbers of LED(s) 202 and gas discharge lamp (s) and coordination of dimming, activation, and deactivation of the LED(s) 202 and gas discharge lamp(s) 204 to achieve desired dimming levels and life spans of the light fixture 214 are matters of design choice. Additionally, the light fixture 214 can be initially activated at a dimming level between 0 and 100% by initially dimming the LED(s) 202 and/or the gas discharge lamp(s) 204.

Figure 4:
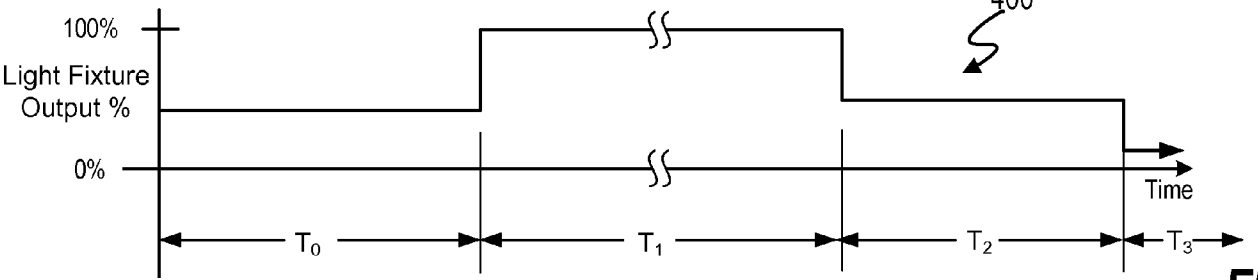
FIG. 4 depicts a light fixture output graph that generally correlates in time with the LED-gas discharge lamp coordination graph of FIG. 3.

FIG. 4 depicts a light fixture output graph 400 that generally correlates in time with the LED-gas discharge lamp coordination graph 300. Light fixture output graph 400 depicts the overall light output of light fixture 214 resulting from the coordination of LED(s) 202 and gas discharge lamp(s) 204 by control system 212 during overlapping, non-identical periods of time.

Figure 5:
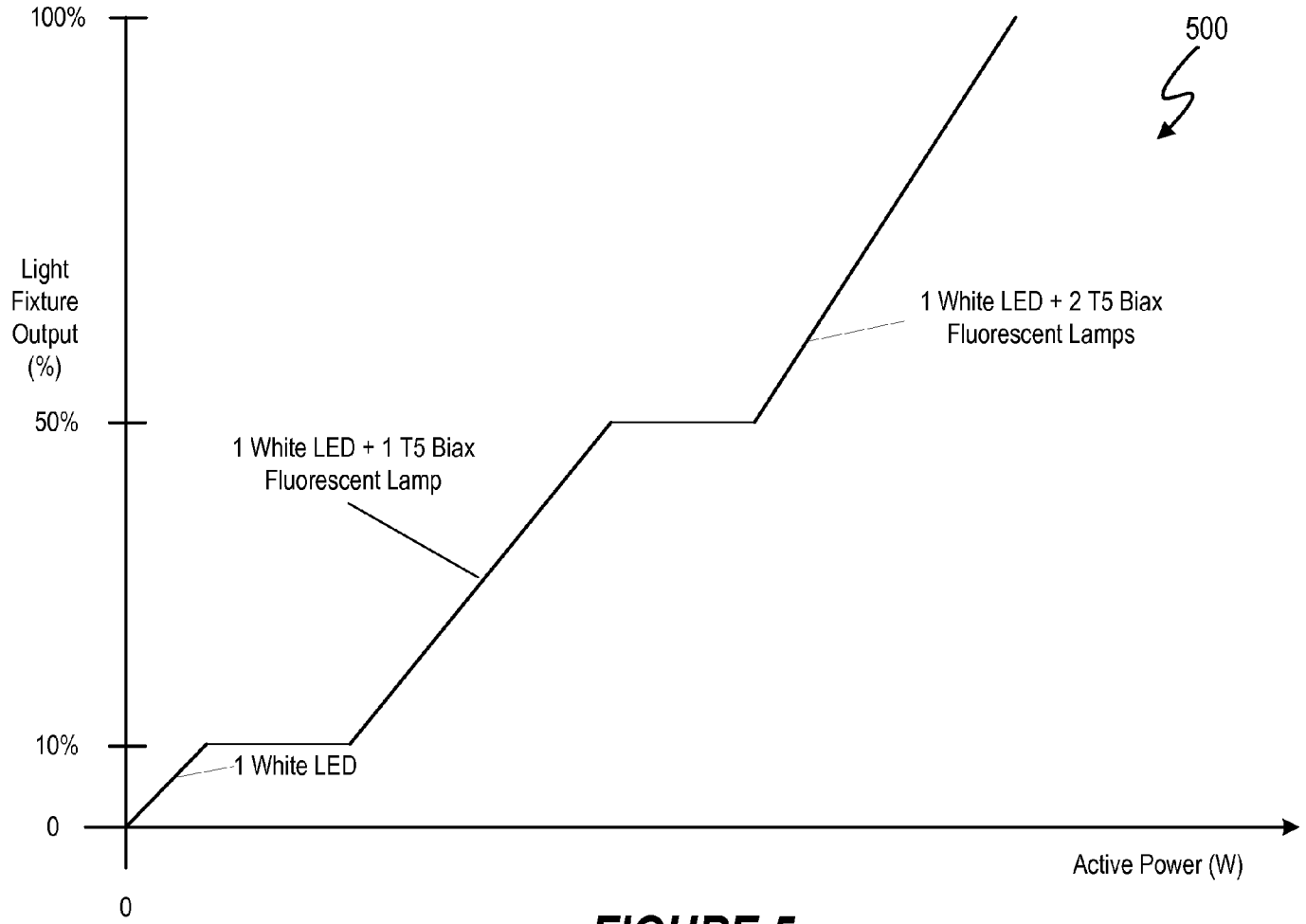
FIG. 5 depicts a graph that shows light fixture output percentages versus consumed power for various combinations of LEDs and fluorescent gas discharge lamps.

FIG. 5 depicts a light output-power graph 500 that represents exemplary light fixture output percentages versus consumed power for one white LED and 2 T5 biax fluorescent lamps. With only the LED activated and light output dimmed between 0 and 10%, the light fixture 212 operates efficiently by converting nearly all power into light. Activating one of the T5 biax fluorescent lamps reduces efficiency because, for example, some drive current is converted into heat to heat the filaments of the fluorescent lamp. However, efficiency improves as light fixture output levels increase between 10% and 50%. Activating both fluorescent lamps and deactivating the LED for light fixture output levels varying between 50% and 100% results in improved efficiency for the LED-fluorescent lamps combination. Thus, dependent control of the LED-fluorescent lamp configuration improves efficiency compared to using only fluorescent lamps and also achieves lighting intensity levels using fewer LEDs compared to using an identical number of LEDs only.

Figure 6:
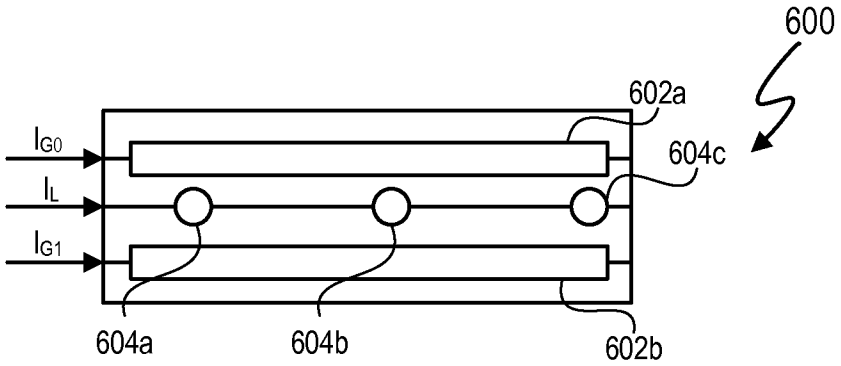
FIGS. 6 and 7 depict respective exemplary lighting fixtures with respective physical arrangements of fluorescent lamps and LEDs.
Figure 7:
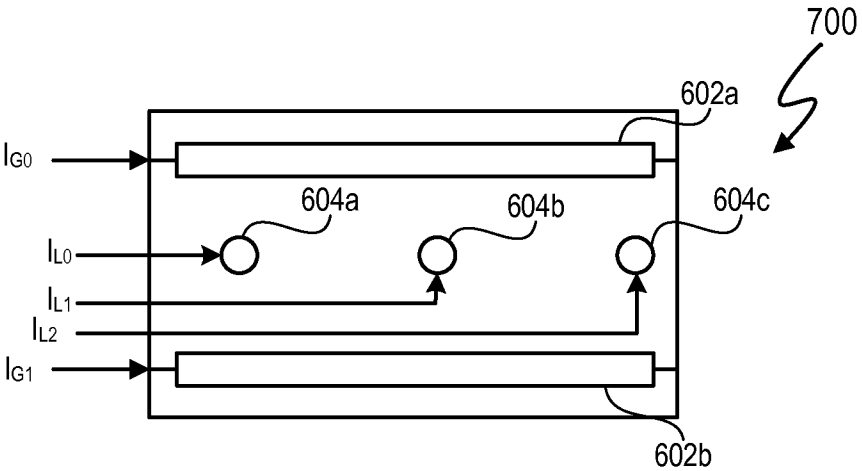

FIGS. 6 and 7 depict respective, exemplary lighting fixtures 600 and 700 with respective physical arrangements of 2 fluorescent lamps 602*a* and 602*b* and 3 LEDs 604*a*, 604*b*, and 604*c*. Control system 212 independently controls gas discharge lamps 602*a* and 602*b* with current drive signals $I_{G0}$ and $I_{G1}$ from light source driver 210. Control system 212 controls LEDs 604*a*, 604*b*, and 604*c* as a group in lighting fixture 600 with current drive signal $I_L$ from light source driver 210. In lighting fixture 700, control system 212 independently controls LEDs 604*a*, 604*b*, and 604*c* with respect current drive signals $I_{L0}$, $I_{L1}$, and $I_{L2}$ from light source driver 210. Allowing more independent control by control system 212 over the light sources in light fixture 212 increases the flexibility of control with the tradeoff of, for example, increased complexity of control system 212 and light source driver 210. The number and type of LEDs and gas discharge lamps is a matter of design choice and depends on, for example, cost, light output, color, and size. In at least one embodiment, the LEDs are disposed within gas discharge lamps.

Thus, in at least one embodiment, the control system 212 can instantaneously provide light output while extending the useful life of each gas discharge lamp and reduce power consumption at low dimming levels.

Although the present invention has been described in detail, it should be understood that various changes, substitutions and alterations can be made hereto without departing from the spirit and scope of the invention as defined by the appended claims. For example, lighting system 200 can include multiple light fixtures, such as light fixture 214, with LED-gas discharge light combinations. The control system 212 and light source driver 210 can be configured to control each of the light fixtures as, for example, described in conjunction with the control of light fixture 212.

What is claimed is:

1. A hybrid gas discharge lamp-light emitting diode (LED) lighting system comprising:

a housing;

an LED retained by the housing;

a gas discharge lamp retained by the housing; and a control system coupled to the LED and the gas discharge lamp to dependently operate the LED and gas discharge lamp during overlapping, non-identical periods of time to control light intensity to (A) dim at least one of (i) the LED and (ii) the gas discharge lamp at a dimming level from 0 to 100% and intermediate dimming levels in response to a signal received by the lighting system and (B) activate the LED while preheating the gas discharge lamp prior to generation of light output from the gas discharge lamp.

2. The hybrid gas discharge lamp-LED lighting system of claim 1 wherein the gas discharge lamp is a member of a group consisting of: a fluorescent lamp, a mercury vapor lamp, a low pressure sodium lamp, and a high pressure sodium lamp.

3. The hybrid gas discharge lamp-LED lighting system of claim 1 further comprising multiple LEDs retained by the housing, wherein the control system is also coupled to the multiple LEDs to dependently operate at least one of the LEDs and the gas discharge lamp during overlapping, non-identical periods of time to control light intensity to dim at least one of (i) the LEDs and (ii) the gas discharge lamp at a dimming level from 0 to 100% and intermediate dimming levels in response to the signal received by the lighting system.

4. The hybrid gas discharge lamp-LED lighting system of claim 3 wherein the gas discharge lamp is a member of a group consisting of: a fluorescent lamp, a mercury vapor lamp, a low pressure sodium lamp, and a high pressure sodium lamp.

5. The hybrid gas discharge lamp-LED lighting system of claim 3 further comprising multiple gas discharge lamps retained by the housing, wherein the control system is also coupled to the multiple gas discharge lamps to dependently operate at least one of the LEDs and at least one of the gas discharge lamps during overlapping, non-identical periods of time to control light intensity to dim at least one of (i) the LEDs and (ii) the gas discharge lamps at a dimming level from 0 to 100% and intermediate dimming levels in response to the signal received by the lighting system.

6. The hybrid gas discharge lamp-LED lighting system of claim 1 wherein the control system is further configured to adjust drive current to the LED from 0 to 100% including intermediate values in response to the signal.

7. The hybrid gas discharge lamp-LED lighting system of claim 6 wherein the control system is further configured to control an ON and OFF state of the LED and the gas discharge lamp in response to the signal.

8. The hybrid gas discharge lamp-LED lighting system of claim 1 further comprising multiple LEDs retained by the housing, wherein the control system is further configured to adjust drive current to the LEDs from 0 to 100% including intermediate values in response to the signal.

9. The hybrid gas discharge lamp-LED lighting system of claim 1 wherein the control system is further configured to activate the LED prior to activating the gas discharge lamp when the lighting system is turned 'on'.

10. The hybrid gas discharge lamp-LED lighting system of claim 1 wherein the signal is a dimming signal.

11. The hybrid gas discharge lamp-LED lighting system of claim 10 wherein the dimming signal is generated by a dimmer.

12. A method of controlling a hybrid gas discharge lamp-light emitting diode (LED) lighting system, the method comprising:

receiving a signal; and operating an LED and a gas discharge lamp dependently during overlapping, non-identical periods of time to control light intensity to (A) dim at least one of (i) the LED and (ii) the gas discharge lamp at a dimming level from 0 to 100% and intermediate dimming levels in response to the signal received by the lighting system and (B) activate the LED while preheating the gas discharge lamp prior to generation of light output from the gas discharge lamp, wherein the LED and the gas discharge lamp are retained in a housing.

13. The method of claim 12 wherein the gas discharge lamp is a member of a group consisting of: a fluorescent lamp, a mercury vapor lamp, a low pressure sodium lamp, and a high pressure sodium lamp.

14. The method of claim 12 wherein the housing further retains multiple LEDs, the method further comprising:

operating at least one of the multiple LEDs and the gas discharge lamp dependently during overlapping, non-identical periods of time to control light intensity to dim at least one of (i) the multiple LEDs and (ii) the gas discharge lamp at a dimming level from 0 to 100% and intermediate dimming levels in response to the signal received by the lighting system.

15. The method of claim 14 wherein the gas discharge lamp is a member of a group consisting of: a fluorescent lamp, a mercury vapor lamp, a low pressure sodium lamp, and a high pressure sodium lamp.

16. The method of claim 14 wherein the housing further retains multiple gas discharge lamps, the method further comprising:

operating at least one of the multiple LEDs and at least one of the gas discharge lamps dependently during overlapping, non-identical periods of time to control light intensity to dim at least one of (i) the LEDs and (ii) the gas discharge lamps at a dimming level from 0 to 100% and intermediate dimming levels in response to the signal received by the lighting system.

17. The method of claim 12 further comprising:

adjusting drive current to the LED from 0 to 100% including intermediate values in response to the signal.

18. The method of claim 17 further comprising:

controlling an ON and OFF state of the LED and the gas discharge lamps in response to the signal.

19. The method of claim 12 wherein the housing further retains multiple LEDs, the method further comprising:

adjusting drive current to the multiple LEDs from 0 to 100% including intermediate values in response to the signal.

20. The method of claim 12 further comprising:

activating the LED prior to activating the gas discharge lamp when the lighting system is turned 'on'.

21. The method of claim 12 wherein the signal is a dimming signal.

22. The method of claim 21 wherein the dimming signal is generated by a dimmer.

23. An apparatus to control at least light intensity of a hybrid gas discharge lamp-light emitting diode (LED) lighting system, the controller comprising:

a controller configured to:

receive a signal; and operate an LED and a gas discharge lamp dependently during overlapping, non-identical periods of time to control light intensity to (A) dim at least one of (i) the LED and (ii) the gas discharge lamp at a dimming level from 0 to 100% and intermediate dimming levels in response to the signal received by the controller and (B) activate the LED while preheating the gas discharge lamp prior to generation of light output from the gas discharge lamp, wherein the LED and the gas discharge lamp are retained in a housing.

24. The apparatus of claim 23 wherein the gas discharge lamp is a member of a group consisting of: a fluorescent lamp, a mercury vapor lamp, a low pressure sodium lamp, and a high pressure sodium lamp.

25. The apparatus of claim 23 wherein the housing further retains multiple LEDs and the controller is further configured to:

operate at least one of the multiple LEDs and the gas discharge lamp dependently during overlapping, non-identical periods of time to control light intensity to dim at least one of (i) the LEDs and (ii) the gas discharge lamp at a dimming level from 0 to 100% and intermediate dimming levels in response to the signal received by the lighting system.

26. The apparatus of claim 23 wherein the gas discharge lamp is a member of a group consisting of: a fluorescent lamp, a mercury vapor lamp, a low pressure sodium lamp, and a high pressure sodium lamp.

27. The apparatus of claim 23 wherein the housing further retains multiple gas discharge lamps and the controller is further configured to:

operate at least one of the multiple LEDs and at least one of the gas discharge lamps dependently during overlapping, non-identical periods of time to control light intensity to dim at least one of (i) the LEDs and (ii) the gas discharge lamps at a dimming level from 0 to 100% and intermediate dimming levels in response to the signal received by the lighting system.

28. The apparatus of claim 23 wherein the controller is further configured to adjust drive current to the LED from 0 to 100% including intermediate values in response to the dimming signal.

29. The apparatus of claim 23 wherein the controller is further configured to:

control an ON and OFF state of the LED and the gas discharge lamps in response to the signal.

30. The apparatus of claim 23 wherein the housing further retains multiple LEDs and the controller is further configured to adjust drive current to the multiple LEDs from 0 to 100% including intermediate values in response to the signal.

31. The apparatus of claim 23 wherein the controller is further configured to:

activate the LED prior to activating the gas discharge lamp when the lighting system is turned 'on'.

32. The apparatus of claim 23 wherein the signal is a dimming signal.

33. The apparatus of claim 32 wherein the dimming signal is generated by a dimmer.

* * * * *